United States Patent [19]

Reeves, Jr. et al.

[11] Patent Number: 4,998,911

[45] Date of Patent: Mar. 12, 1991

[54] LID ALIGNMENT AND FIXING APPARATUS

[75] Inventors: Robert H. Reeves, Jr., Freeport; Charles R. Cox, Brazoria; Hilario Montes, Freeport, all of Tex.

[73] Assignee: Velasco Scale Company, Freeport, Tex.

[21] Appl. No.: 340,065

[22] Filed: Apr. 18, 1989

[51] Int. Cl.[5] ..... B65G 47/244

[52] U.S. Cl. ..... 493/108; 198/394; 193/46; 221/172; 413/3

[58] Field of Search ..... 493/87, 102, 108, 114, 493/115; 413/3, 26; 221/172, 173; 193/46; 198/394

[56] References Cited

U.S. PATENT DOCUMENTS 3,487,904 1/1970 Aguilar ..... 193/46

4,354,588 10/1982 Wolfertz ..... 198/394

*Primary Examiner*—Frederick R. Schmidt

*Assistant Examiner*—Jack Lavinder

*Attorney, Agent, or Firm*—Arnold, White & Durkee

[57] ABSTRACT

An apparatus 10 controls the orientation of a lid section 16 prior to mating the lid section 16 with a pail section 14 to form a complete container 17. The lid section 16 has bunghole 18 of a preselected diameter positioned at a preselected radial distance from the center of the lid section 16. The bunghole 18 is defined by an annular wall extending a preselected distance from a lower surface of the lid section 16. A first plate 54 receives the lid section 16 with the bunghole 18 extending into a central passage 56. The central passage 56 extends athrough 56 the plate 54 with an upper section 58 of the passage 56 having a preselected width at least twice the preselected radial distance of the bunghole 18 from the center of the lid section 16. A lower section 60 of the passage 56 has a preselected width at least as wide the bunghole diameter. A gating mechanism 28 has a substantially V-shaped cross section and is positioned within the central passage 56 between the upper and lower sections 58, 60 with the apex of the V-shaped cross section adjacent the lower section 60 of the central passage 56. The gating mechanism 28 is adapted for receiving the bunghole 18 of the lid section 16. A pneumatic cylinder 26 is connected to the gating mechanism 28 and operates to move the gating mechanism 28 between first and second preselected positions to respectively receive and release the lid section 16.

20 Claims, 3 Drawing Sheets

12
10
26
28
14
16
18
17
20
22
24
30
36
34
34
37
38
32
39

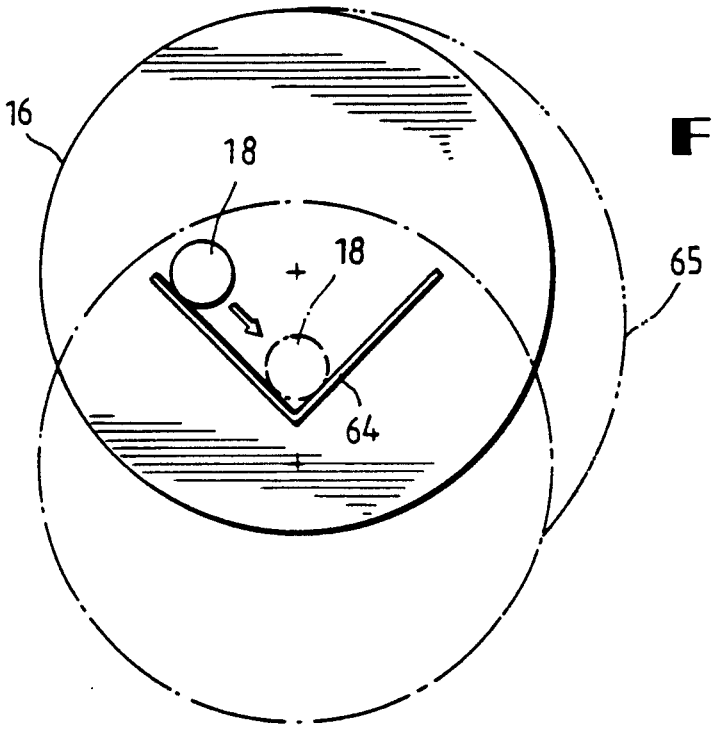
FIG.3
FIG.4
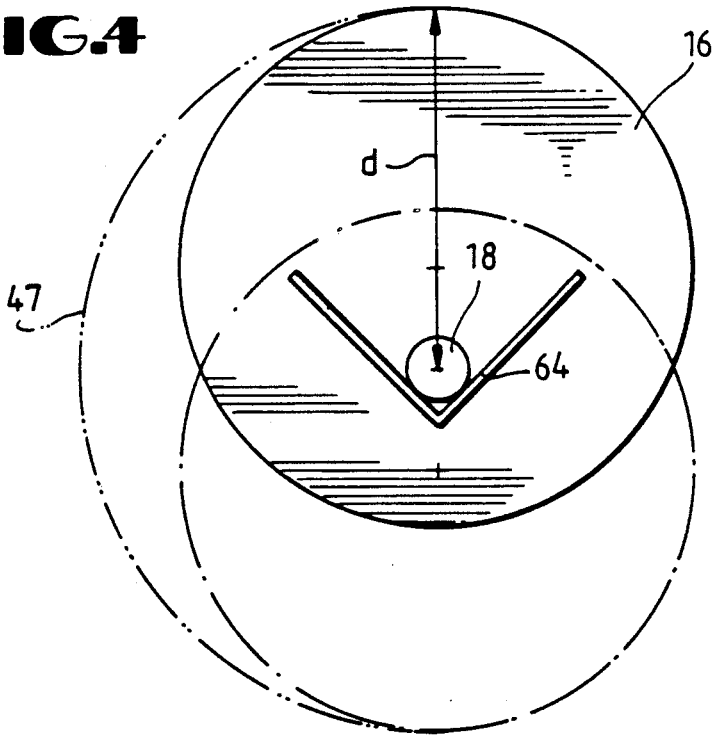

LID ALIGNMENT AND FIXING APPARATUS

BACKGROUND OF THE INVENTION

1. Field of the Invention

This invention relates generally to an apparatus for aligning a lid section to be automatically positioned on a pail section of a closed container, and more particularly, to an apparatus for properly orienting a bunghole in the lid section prior to mating the lid and pail sections.

2. Description for the Related Art

In the past, bulk liquids have typically been packaged for shipping in 55 gallon drums. However, more recently the demand for liquids packaged in much smaller 5 gallon pails has increased dramatically. Accompanying this increased demand for 5 gallon pails is a need to more efficiently and quickly dispense liquids into the 5 gallon pails in an automatic manner similar to that used in the 55 gallon drum market.

In the field of automatic filling apparatus for 55 gallon drums, it is typical for the liquid to be introduced through a bunghole in order to limit contact between the liquid and the atmosphere. However, since the bunghole is relatively small and its angular position can be at any of a variety of locations, the prior art has typically employed various devices for aligning the bunghole. For example, U.S. Pat. No. 4,494,583 issued Jan. 22, 1985 to Reeves et al. discloses one such apparatus. Typically, the entire 55 gallon drum is rotated about its longitudinal axis until the bunghole is located at a desired position. The equipment required to move these large, bulky drums is expensive, cumbersome, and prone to mechanical failure.

Five gallon pails, unlike 55 gallon drums, are of a two-piece construction, consisting of a pail section and a removable lid section. The lid section typically includes a bunghole that should be properly oriented relative to the pail section. Accordingly, automated alignment of the lid section so as to position the bunghole prior to mating the lid and pail sections is desirable. It is preferable, however, to avoid the complicated and expensive machinery associated with bunghole alignment of 55 gallon drums. On the other hand, it is equally desirable that loading of the lid sections is not limited to a manual process that requires precise positioning of the bungholes. Rather, it is preferred that the lid sections may be loaded with the bungholes randomly located.

The present invention is directed to overcoming one or more of the problems as set forth above.

SUMMARY OF THE INVENTION

The primary object of the present invention is to provide an apparatus for aligning the lid section of a container so as to properly orient a bunghole in the lid section prior to mating with a pail section of the container.

Another object of the present invention is to provide such a device that is inexpensive to produce yet reliable in operation.

In one aspect of the present invention an apparatus is provided for orienting a lid section of a container to a preselected angular position and mating the lid section to a pail section of a container. The lid section has a bunghole of preselected diameter positioned at a preselected radial distance from the center of the lid section. The bunghole is defined by an annular wall connected to and extending a preselected distance from a lower surface of the lid section.

The apparatus includes a frame having a pair of rails spaced a preselected distance apart and connected together via a plate. The plate has a central passage extending therethrough where an upper section of the passage has a preselected width at least twice the preselected radial distance. A lower section of the passage has a preselected width at least as wide as the bunghole diameter. The plate has a first surface adapted for receiving the lid section whereby the bunghole extends into the central passage.

A gating mechanism is positioned within the central passage intermediate the upper and lower sections of the passage and is adapted for receiving the bunghole and urging the bunghole and lid section toward a position at which the bunghole is located at the upper center location of the lid section. Means for moving the gating mechanism between first and second preselected positions is also provided. The first preselected position is where the gating mechanism is substantially adjacent the first surface of the plate and the second preselected position is where the gating mechanism is spaced a preselected distance from the first surface of the plate. Thus, the gating mechanism receives the bunghole in the first position and releases the bunghole in the second position.

In another aspect of the present invention an apparatus is provided for orienting a lid section of a container to a preselected angular position and mating the lid section to a pail section of a container. The lid section has a bunghole of a preselected diameter positioned at a preselected radial distance from the center of the lid section. The bunghole is defined by an annular wall extending a preselected distance from a lower surface of the lid section. The apparatus includes a frame having a pair of rails spaced a preselected distance apart and connected together via a plate. The plate has a central passage extending therethrough where an upper section of the passage has a preselected width at least twice the preselected radial distance. A lower section of the passage has a preselected width at least as wide as the bunghole diameter. The plate has a first surface adapted for receiving the lid section whereby the bunghole extends into the central passage. A gating mechanism has a substantially V-shaped cross section and is positioned within the central passage intermediate the upper and lower sections of the passage with the apex of the V-shaped cross section being adjacent the lower section of the central passage. The gating mechanism is adapted for receiving the bunghole of the lid section. Means for moving the gating mechanism between first and second preselected positions is also provided. The first preselected position is where the gating mechanism is substantially adjacent the first surface of the plate and the second preselected position is where the gating mechanism is spaced a preselected distance from the first surface of the plate. Thus, the gating mechanism receives the bunghole in the first position and releases the bunghole in the second position.

BRIEF DESCRIPTION OF THE DRAWINGS

Other objects and advantages of the invention will be come apparent upon reading the following detailed description and upon reference in which:

FIG. 3 illustrates the interaction of the gating mechanism of the instant apparatus and a lid section that has its bunghole displaced 90 degrees from the desired position;

FIG. 4 illustrates the interaction of the gating mechanism of the instant apparatus and a lid section that has its bunghole displaced approximately 180 degrees from the desired position.

Figure 1:
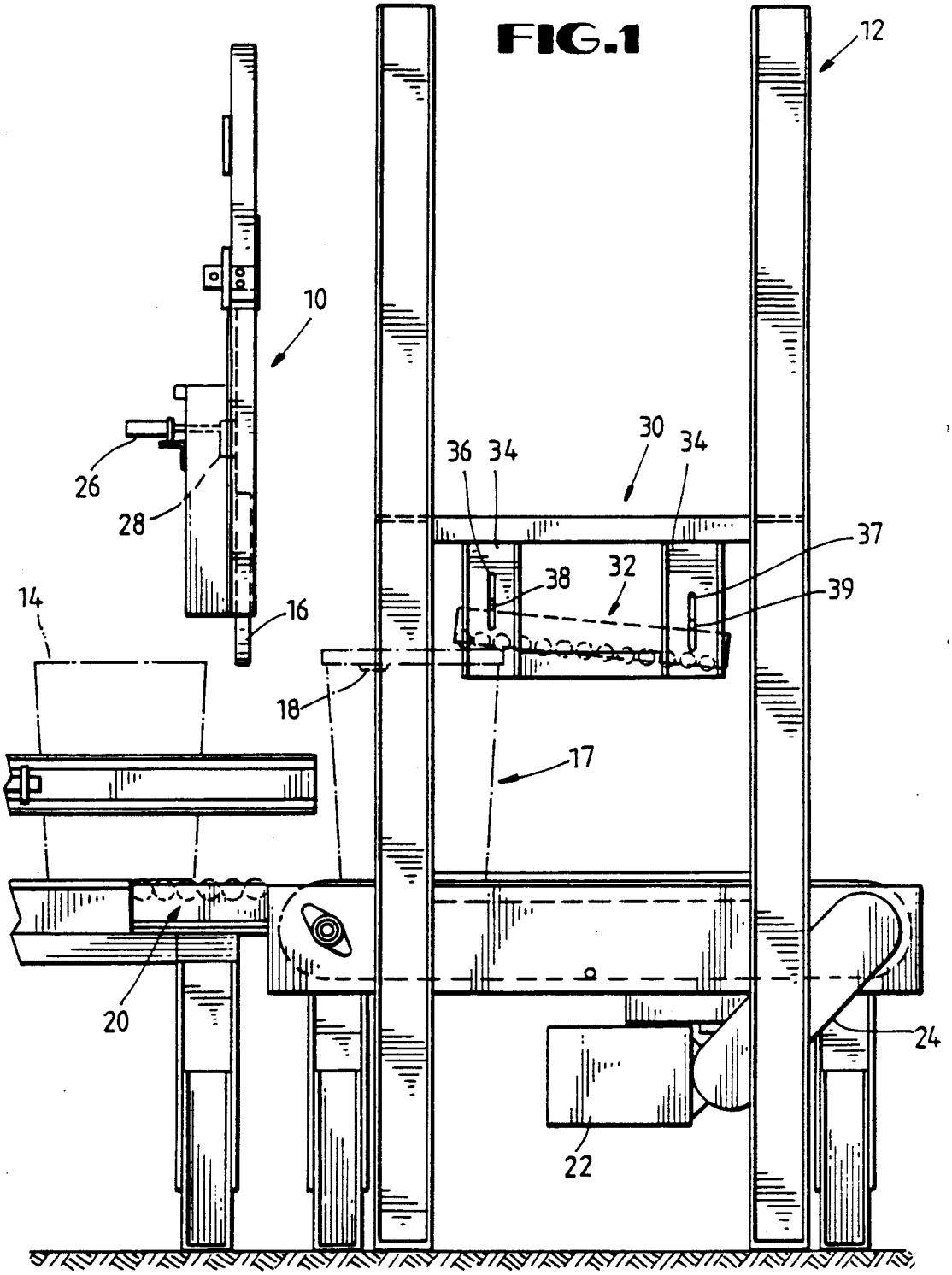
FIG. 1 is a side view of the instant apparatus disposed in a portion of an assembly line.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Turning now to the drawings and referring first to FIG. 1, a side view of an instant apparatus 10 and its position within a portion of an assembly line 12 is illustrated. The function of the illustrated portion of the assembly line 12 is to automatically mate a pail section 14 and lid section 16 to form a single complete container 17.

On this assembly line 12, it is contemplated that the lid section 16 is mated to the pail section 14 either before or after filling the completed container 17. Thus, in one embodiment a bunghole 18 extends through the lid section 16 in order to provide limited access to the interior of the container 17 by a filling lance (not shown) at a later stage in the assembly line 12. Alternatively, the pail section 14 can be filled prior to mating the lid and pail sections 16, 14. It is important to note that the bunghole 18 is defined by an annular sidewall that extends below the lower surface of the lid section 16.

The instant apparatus 10 is concerned with orienting the lid section 16 so as to position the bunghole 18 at a desired location. Thus, at the later assembly line stage, the filling lance (not shown) or other automated equipment will properly engage the bunghole 18 without the need for complicated control machinery to locate a randomly placed bunghole 18.

The container 17 traverses the assembly line 12 on a series of powered rollers 20. The rollers 20 are powered, for example, by an electric motor 22 connected to the rollers 20 via a power belt 24. The powered rollers 20 are conventional in the field of assembly line machine tools. The rollers 20 are disposed with a longitudinal axis perpendicular to the desired direction of travel. Thus, rotation of the rollers 20 about their respective longitudinal axes urges the pail section 14 in a direction generally perpendicular to the roller longitudinal axes. Thus, in FIG. 1, the pail sections 14 move generally from left to right.

The apparatus 10 is disposed above the powered rollers 20 and the pail section 14. The lid section 16 is presented generally vertically with the lower edge of the lid section 16 extending below the upper edge of the pail section 14. Therefore, it can be seen that as the pail section 14 moves from left to right, the upper section of the pail section 14 engages the lower section of the lid section 16. Continued movement of the pail section 14 from left to right angularly displaces the lid section 16 until such time as the pail section 14 has moved a sufficient distance to disengage the lid section 16 from the apparatus 10, allowing the lid section 16 to fall in place on the pail section 14.

Of course, it is preferred that an additional lid section 16 is moved into the position previously occupied by the just dispensed lid section 16. In this manner, the apparatus 10 provides a lid section 16 for the next pail section 14 present on the assembly line 12. Clearly, the process is continually repeated each time a pail section 14 passes under the apparatus 10.

The dispensing action of the apparatus 10 is preferably controlled by a pneumatic cylinder 26 that actuates a gating mechanism 28. The interaction of the gating mechanism 28 and lid section 16 is described in greater detail in conjunction with FIGS. 2 and 3. It should be appreciated that control of the gating mechanism 28 may be effected by other devices similar in operation to the pneumatic cylinder 26. For example, electromagnetic and hydraulic cylinders can be readily substituted for the pneumatic cylinder 26 without departing from the spirit and scope of the invention.

In the subsequent stage of the assembly line 12 the lid section 16 is positively mated to the pail section 14 via a press 30. The press 30 includes a vertically moveable array of rollers 32. The rollers 32 are disposed having longitudinal axes generally perpendicular to the direction of travel of the pail section 14. The array of rollers 32, unlike the rollers 20, are not powered, but are free to rotate in response to contact with the upper surface of the lid section 16. The rollers 32 allow for low-friction contact between the lid section 16 and the press 30. This low-friction contact prevents undesirable displacement of the lid section 16 relative to the pail section 14. A set of depending arms 34 capture the array of rollers 32 against horizontal movement but have a series of vertical slots 36, 37 that accept guide pins 38, 39 extending from the array of rollers 32. The guide pins 38, 39 have a diameter slightly less than the width of the vertical slots 36, 37, such that the guide pins 38, 39 are free to move vertically within the slots 36, 37 but are captured against horizontal movement. As container 17 approaches the array of rollers 32, the rollers positioned on the left side of the array 32 engage the upper surface of the lid section 16 and are urged upward until the guide pin 38 engages the upper end of the slot 36. As container 17 continues moving along the powered rollers 20, the lid section 16 engages more of the roller array 32, thereby forcing the rollers positioned on the right side of the roller array 32 vertically upward until the guide pin 39 engages the upper end of the vertical slot 37.

It should be noted, however, that the upper end of the vertical slot 37 is located at a lower vertical height than the upper end of the vertical slot 36. Thus, as the container 17 traverses under the roller array 32, the vertical clearance between the powered rollers 20 and the roller array 32 decreases from left to right. Accordingly, by properly positioning the roller array 32 at the correct vertical height, the lid section 16 is urged downward into a mating relationship with the pail section 14. By carefully selecting the vertical spacing between the powered rollers 20 and the right side of the roller array 32 to match the known height of the combined pail section 14 and lid section 16, the press 30 ensures that the lid section 16 is properly mated to the pail section 14.

It should be recognized that the assembly line 12 contains additional machine tools that perform their desired operation subsequent to the press 30. One of these additional machine tools is the automated filling apparatus (not shown), which introduces a filling lance into the properly oriented bunghole 18.

Figure 2:
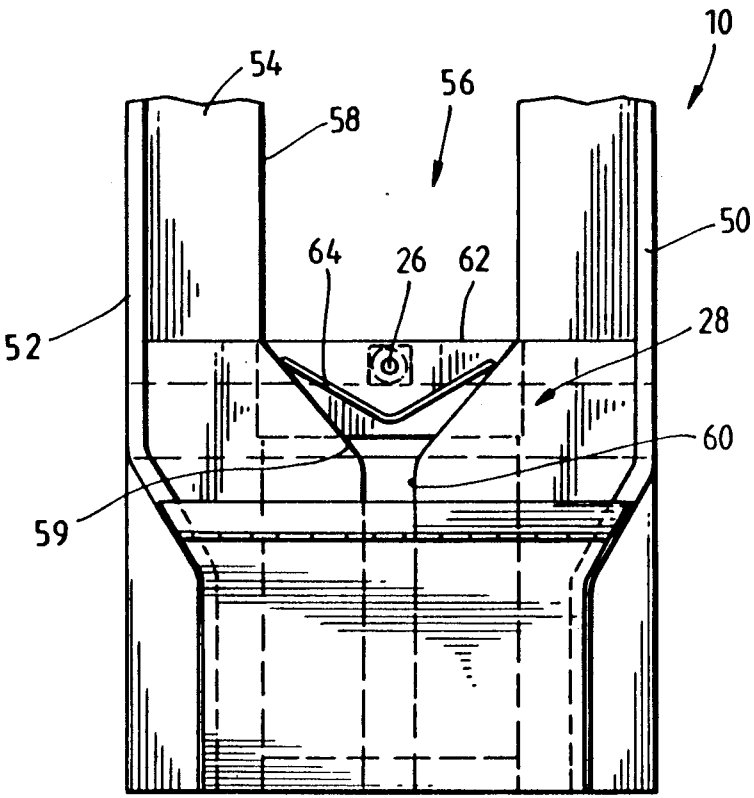
FIG. 2 is an end view of the instant apparatus.

Referring now to FIG. 2, an end view of the lid section dispensing apparatus 10 is illustrated. The apparatus 10 includes a pair of vertical, parallel rails 50, 52. The rails 50, 52 are held into position by a plate 54 fixed to the back of each of the rails 50, 52. The plate 54 is generally rectangular in configuration with a central passage 56 extending therethrough. The passage 56 includes an upper section 58 that is substantially rectangular in configuration and narrows to a lower section 59. The lower section 59 includes a channel 60 that is also substantially rectangularing in cross section, but has a width of approximately the same dimension as the bunghole 18. The dimension of the upper section 58 of the passage 56 is selected so that a centrally located lid section 16 will lie flat on the plate 54 with the bunghole 18 extending into the passage 56 irrespective of the angular location of the bunghole 18 in the lid section 16. Thus, the lid sections 16 may be loaded into the apparatus 10 with the bungholes 18 randomly located. More simply stated, the width of the upper section 58 is only slightly greater than twice the distance between the centerpoint of the lid section 16 and the outer edge of the bunghole 18.

The gating mechanism 28, in addition to selectively releasing each lid section 16, also acts to orient the lid section 16 so that the bunghole 18 is located at the top center of each lid section 16. The gating mechanism 28 includes a backplate 62 that is threadibly attached to the pneumatic cylinder 26. A V-bracket 64 is affixed to the face of the backplate 62 and extends generally perpendicular therefrom. The V-bracket 64 is oriented with its apex positioned vertically lower than the remainder of the V-bracket 64.

Further, the V-bracket 64 extends flush with the plate 54 so that the lid section 16 may ordinarily pass over the V-bracket 64. Only the bunghole 18 contacts the V-bracket 64 since the bunghole 18 extends below the plane defining the lower surface of the lid section 16. Thus, it can be appreciated that as the lid section 16 falls downward toward the V-bracket 64 the bunghole 18 engages the surface of the V-bracket 64 and is urged in a direction generally toward the apex of the V-bracket 64. Gravity causes the lid section 16 to rotate about the bunghole 18 while the bunghole 18 also moves toward the apex of the V-bracket 64.

Therefore, it should be appreciated that the rails 50, 52 are displaced a sufficient distance apart to allow the lid section 16 to rotate about the bunghole 18 without engaging the rails, 50, 52. For example, in the ideal situation the lid section 16 is introduced at the upper section 58 of the channel 56 with its bunghole 18 already positioned at the upper center section of the lid section 16. Thus, when the bunghole 18 engages the upper surface of the V-bracket 64 it will do so at the apex of the V-bracket 64. No rotation of the lid section 16 will occur since the bunghole 18 is already properly located.

On the other hand, where the bunghole 18 is disposed at a large angular distance from its desired position at the upper center section of the lid section 16, the bunghole 18 engages the upper surface of the V-bracket 64 at a preselected distance from the apex of the V-bracket 64.

For example, in FIG. 3 the bunghole 18 is displaced 90 degrees from its desired location. The bunghole 18 engages the V-bracket 64 not at its apex, but near the outer end of the V-bracket 64. Thus, the lid section 16, because of its own weight, rotates about the contact point between the V-bracket 64 and the bunghole 18 while sliding down the upper surface of the V-bracket 64 towards the apex. Thus, it can be seen that rotation of the lid section 16 about the bunghole 18 causes the path of the lid section 16 to move outside the vertical path defined by the diameter of the lid section 16. Therefore, the distance between the rails 50, 52 must be sufficient to accommodate this rotational alignment induced by the V-bracket 64. The path of the lid section 16 is defined by the dashed line 65.

The distance between the rails 50, 52 should be wide enough to accommodate the worst case alignment condition. The worst case alignment condition occurs when the bunghole 18 is displaced 180 degrees from its desired location, as shown in FIG. 4. In this case, the lid section 16 rotates through an arc defined as the distance (d) between the bunghole 18 and the opposite edge of the lid section 16. Accordingly, the distance between the rails 50, 52 should be at least twice this distance (d). The path of the opposite edge of the lid section 16 is identified by the dashed line 47.

Referring once again to FIG. 2, since the lid section 16 is properly oriented by the gating mechanism 28, no additional rotation of the lid section 16 should occur below the gating mechanism 28. Therefore, the rails 50, 52 converge below the gating mechanism 28 to a distance apart that is only slightly greater than the diameter of the lid section 16. Below the gating mechanism 28 it is sufficient to maintain the alignment that the gating mechanism has effected. Thus, the central passage 56 similarly converges to the channel 60, which does not reorient the lid section 16, but merely maintains the orientation established by the gating mechanism 28.

The gating mechanism 28 is actuable by the pneumatic cylinder 26 so that the backplate 62 and V-bracket 64 are withdrawn from the passage 56, thereby disengaging V-bracket 64 from the bunghole 18. Thus, the lid section 16 is free to fall further into the space between the rails 50, 52 with the bunghole 18 captured in the channel 60. The lid section 16 continues moving downward until the bunghole 18 engages the bottom section of the channel 60, thereby preventing further downward movement. In this position, the lid section 16 assumes the position illustrated in FIG. 1 wherein the lower section of the lid section 16 extends below the upper section of the pail section 14.

It should be appreciated that actuation of the gating mechanism 28 by the pneumatic cylinder 26 is momentary. That is to say, the gating mechanism 28 is withdrawn from the central passage 56 only for a sufficient amount of time to allow a single lid section 16 to pass to the bottom of the slot 60. Any other lid section 16 positioned vertically above the presently released lid section 16 cannot fall below the gating mechanism 28. Rather, the gating mechanism 28 returns to its position substantially flush with the plate 54 so that the bunghole 18 of the next lid section 16 similarly engages the V-bracket 64 and is reoriented to the desired position where the bunghole 18 is located in the upper center section of the lid section 16.

Figure 5:
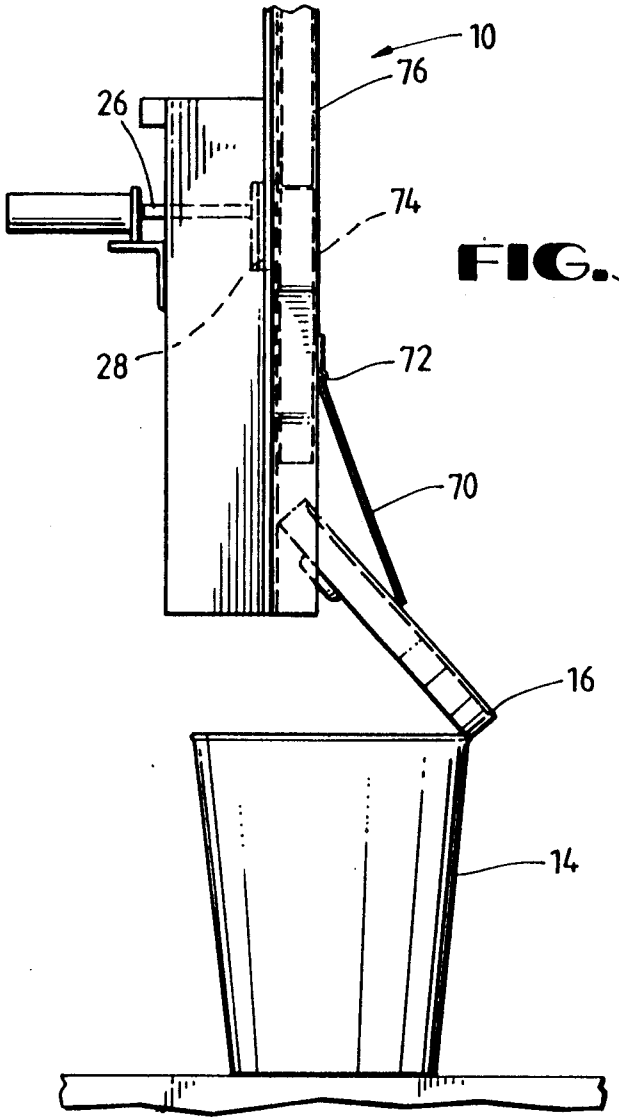
FIG. 5 is a detailed side view of the instant apparatus and its relation to the lid and pail sections of the container.

Referring now to FIG. 5, a side view of the apparatus 10 is illustrated in greater detail so as to enhance the understanding of the operation of the apparatus 10. A plate section 70 is connected to the apparatus 10 via a hinge, which is preferably a piano hinge 72 extending transversely between the rails 50, 52. Thus, as the pail section 14 moves below the apparatus 10 and engages the lower section of the lid section 16, the lid section 16 rotates about its contact point between the lid section 16 and the plate 54. Similarly, contact between the lid section 16 and plate 70 causes the plate 70 to rotate about the center point of the hinge 72. The lid section 16 continues to rotate until the bunghole 18 is forced from the channel 60. Once the pail section 14 has moved a sufficient distance beyond the apparatus 10 so as to disengage the bunghole 18 from the channel 60, the lid section 16 is free to fall from the apparatus 10 onto the upper surface of the pail section 14.

Thereafter, the pneumatic cylinder 26 is momentarily actuated to withdraw the gating mechanism 28 and allow the next lid section 74 to fall into the channel 60 in preparation for passage of the next pail section 14. At the same time, the next lid section 76 falls into the gating mechanism 28 and is aligned so that its bunghole is positioned at the upper center section of the lid section 76.

It should be appreciated that proper operation of the apparatus 10 depends upon gravitational feeding of the lid section 16 into the apparatus 10. Since the lid section 16 may be formed of a relatively lightweight plastic or metallic material, gravitational force exerted on the lid section 16 is relatively low. Thus, a high degree of friction between the plate 54 and lid section 16 reduces the gravitational feeding and inhibits the proper operation of the apparatus 10. Accordingly, the plate 54 is preferably covered, coated, or formed from a material having a low coefficient of friction. For example, the plate could be coated with grease or oil, or constructed from a high density polyethylene material, teflon, or other polytetrafluorans.

In describing the invention, reference has been made to a preferred embodiment. However, those skilled in the art and familiar with the disclosure of the invention may recognize additions, deletions, substitutions or other modifications that would fall within the scope of the invention as defined in the claims.

We claim:

1. An apparatus for orienting a lid section of a container to a preselected angular position and mating said lid section to a pail section of a container, said lid section having a bunghole of a preselected diameter positioned at a preselected radial distance from the center of said lid section, said bunghole being defined by an annular wall connected to and extending a preselected distance from a lower surface of said lid section, the apparatus comprising:

a frame having a pair of rails spaced a preselected distance apart and connected together via a first plate;

said first plate having a central passage extending therethrough, an upper section of said passage having a preselected width at least twice the preselected radial distance, a lower section of said passage having a preselected width at least as wide as said bunghole diameter, said first plate having a first surface adapted for receiving said lid section whereby said bunghole extends into said central passage;

a gating mechanism positioned within said central passage intermediate the upper and lower sections of said passage and adapted for receiving said bunghole and urging said bunghole and lid section toward a position at which said bunghole is located at the upper center location of said lid section; and means for moving said gating mechanism between first and second preselected positions, said first preselected position being where said gating mechanism is substantially adjacent the first surface of said first plate and the second preselected position being where said gating mechanism is spaced a preselected distance from the first surface of said first plate whereby said gating mechanism receives the bunghole in the first position and releases the bunghole in the second position.

2. An apparatus, as set forth in claim 1, wherein said gating mechanism includes a substantially V-shaped cross section positioned within said central passage intermediate the upper and lower sections of said passage with the apex of said V-shaped cross section being adjacent the lower section of said central passage, said V-shaped cross section being adapted for receiving the bunghole of said lid section.

3. An apparatus, as set forth in claim 1, wherein said first plate has an upper and lower edge, said upper section of said central passage extends to and opens onto said upper edge, and said lower section of said central passage terminates a preselected distance from said lower edge.

4. An apparatus, as set forth in claim 1, wherein said pair of rails each have a first and second surface and said first plate is connected to said rails adjacent the first surface of said rails, the apparatus including a second plate having an upper edge hingedly connected to said rails, said second plate being positioned adjacent both the second surface of said rails and the lower section of said central passage whereby a lid section is receivable between the first and second plates.

5. An apparatus, as set forth in claim 1, wherein said first plate is formed from a material having a low coefficient of friction.

6. An apparatus, as set forth in claim 5, wherein said first plate is formed from one of a high density polyethylene, teflon, and a polytetrafluoran.

7. An apparatus, as set forth in claim 1, wherein said first surface of said first plate includes a layer of material having a low coefficient of friction disposed thereon.

8. An apparatus, as set forth in claim 7, wherein said layer of material is formed from one of a high density polyethylene, teflon, and a polytetrafluoran.

9. An apparatus for orienting a lid section of a container to a preselected angular position and mating said lid section to a pail section of a container, said lid section having bunghole of a preselected diameter positioned at a preselected radial distance from the center of said lid section, said bunghole being defined by an annular wall connected to and extending a preselected distance from a lower surface of said lid section, the apparatus comprising:

a frame having a pair of rails spaced a preselected distance apart and connected together via a first plate;

said first plate having a central passage extending therethrough, an upper section of said passage having a preselected width at least twice the preselected radial distance, a lower section of said passage having a preselected width at least as wide as said bunghole diameter, said first plate having a first surface adapted for receiving said lid section whereby said bunghole extends into said central passage;

a gating mechanism having a substantially V-shaped cross section and being positioned within said central passage intermediate the upper and lower sections of said passage with the apex of said V-shaped cross section being adjacent the lower section of said central passage, said gating mechanism being adapted for receiving the bunghole of said lid section; and means for moving said gating mechanism between first and second preselected positions, said first preselected position being where said gating mechanism is substantially adjacent the first surface of said first plate and the second preselected position being where said gating mechanism is spaced a preselected distance from the first surface of said first plate whereby said gating mechanism receives the bunghole in the first position and releases the bunghole in the second position.

10. An apparatus, as set forth in claim 9, wherein said first plate has an upper and lower edge, said upper section of said central passage extends to and opens onto said upper edge, and said lower section of said central passage terminates a preselected distance from said lower edge.

11. An apparatus, as set forth in claim 9, wherein said pair of rails each have a first and second surface and said first plate is connected to said rails adjacent the first surface of said rails, the apparatus including a second plate having an upper edge hingedly connected to said rails, said second plate being positioned adjacent both the second surface of said rails and the lower section of said central passage whereby a lid section is receivable between the first and second plates.

12. An apparatus, as set forth in claim 9, wherein said first plate is formed from a material having a low coefficient of friction.

13. An apparatus, as set forth in claim 12, wherein said first plate is formed from one of a high density polyethylene, teflon, and a polytetrafluoran.

14. An apparatus, as set forth in claim 9, wherein said first surface of said first plate includes a layer of material having a low coefficient of friction disposed thereon.

15. An apparatus, as set forth in claim 14, wherein said layer of material is formed from one of a high density polyethylene, teflon, and a polytetrafluoran.

16. An apparatus for orienting a lid section of a container to a preselected angular position and mating said lid section to a pail section of a container, said lid section having bunghole of a preselected diameter positioned at a preselected radial distance from the center of said lid section, said bunghole being defined by an annular wall connected to and extending a preselected distance from a lower surface of said lid section, the apparatus comprising:

a frame having a pair of rails spaced a preselected distance apart and connected together via a first plate, said rails each having a first and second surface and being connected to said first plate adjacent said first surfaces;

said first plate having an upper and lower edge and a central passage extending therethrough, an upper section of said passage extending to and opening onto said first plate upper edge and having a preselected width at least twice the preselected radial distance, a lower section of said passage terminating a preselected distance from said lower edge and having a preselected width at least as wide as said bunghole diameter, said plate having a first surface adapted for receiving said lid section whereby said bunghole extends into said central passage;

a second plate having an upper edge hingedly connected to said rails, said second plate being positioned adjacent both the second surface of said rails and the lower section of said central passage whereby a lid section is receivable between the first and second plates;

a gating mechanism having a substantially V-shaped cross section and being positioned within said central passage intermediate the upper and lower sections of said passage with the apex of said V-shaped cross section being adjacent the lower section of said central passage, said gating mechanism being adapted for receiving the bunghole of said lid section; and means for moving said gating mechanism between first and second preselected positions, said first preselected position being where said gating mechanism is substantially adjacent the first surface of said first plate and the second preselected position being where said gating mechanism is spaced a preselected distance from the first surface of said first plate whereby said gating mechanism receives the bunghole in the first position and releases the bunghole in the second position.

17. An apparatus, as set forth in claim 16, wherein said first plate is formed from a material having a low coefficient of friction.

18. An apparatus, as set forth in claim 17, wherein said first plate is formed from one of a high density polyethylene, teflon, and a polytetrafluoran.

19. An apparatus, as set forth in claim 16, wherein said first surface of said first plate includes a layer of material having a low coefficient of friction disposed thereon.

20. An apparatus, as set forth in claim 19, wherein said layer of material is formed from one of a high density polyethylene, teflon, and a polytetrafluoran.

* * * * *